US006344829B1

(12) United States Patent
Lee

(10) Patent No.: US 6,344,829 B1
(45) Date of Patent: Feb. 5, 2002

(54) HIGH-ISOLATION, COMMON FOCUS, TRANSMIT-RECEIVE ANTENNA SET

(75) Inventor: Gregory S. Lee, Palo Alto, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/567,238

(22) Filed: May 11, 2000

(51) Int. Cl.[7] ..... H01Q 19/06
(52) U.S. Cl. ..... 343/753; 343/767
(58) Field of Search ..... 343/753, 767, 343/770, 746, 754, 911 L, 872, 700 MS, 909

(56) References Cited

U.S. PATENT DOCUMENTS 5,337,065 A * 8/1994 Bonnet et al. ..... 343/767
5,365,243 A * 11/1994 Buchler et al. ..... 343/753
5,631,659 A * 5/1997 Evans et al. ..... 343/700 MS
6,061,032 A * 5/2000 Sandstedt et al. ..... 343/770
6,188,369 B1 * 2/2001 Okabe et al. ..... 343/767

* cited by examiner

*Primary Examiner*—Don Wong
*Assistant Examiner*—James Clinger

(57) ABSTRACT

A common focus antenna including three slot antennas sets formed in a metallic layer. The metallic layer is supported by a substrate. Two slot antenna sets are arranged parallel to each other and perpendicular to a third antenna set which is positioned between the two parallel slot antenna in the general shape of the letter "H". A lens is provided on the substrate, opposite the metallic layer.

20 Claims, 11 Drawing Sheets

HIGH-ISOLATION, COMMON FOCUS, TRANSMIT-RECEIVE ANTENNA SET

TECHNICAL FIELD

The present invention is generally related to a high isolation antenna and more particularly to an antenna which provides high isolation and wide bandwidth for transmit and receive operations, while at the same time providing for a structure which requires minimal area and volume.

BACKGROUND OF THE INVENTION

In certain radio, microwave, or optical communications applications it is typically necessary to have an antenna system capable of providing sufficient isolation between transmit and receive operations.

Full duplex radio or microwave, has typically relied on isolation techniques, such as, frequency separation or antenna (optical collection) separation. Frequency separation techniques rely on filtering, or separating signals of differing frequencies received via the antenna, before further processing of the signals. Antenna separation techniques are directed toward separating the transmit and receive antenna elements so as to avoid any interference between the two and to provide for optimum gain for both transmit and receive.

Frequency separation techniques typically require the use of high-performance filters. However, these filters are typically bulky and expensive and often are not feasible given the cost constraints at hand. For example, waveguide filters are available which provide excellent performance but are bulky and expensive. Compact, three-dimensional guided-wave filters made using titania ($TiO_2$) as a dielectric, instead of air, are also available however the cost and dimensional tolerances often make them less than ideal.

There are a number of known antenna separation techniques. The highest isolation (on the order of 70 dB) is typically achieved by physically separating the transmit antenna and the receive antenna so that each has separate and distinct high-gain collection optics. Unfortunately, in order to achieve equally high gain in both the transmit and receive systems, a great deal of space is consumed as the required area and volume necessary to provide separate antenna systems will at least double.

Another approach has been to simultaneously feed a main aperture (reflector or lens) with two orthogonally polarized beams, one for transmit and one for receive. A more specific implementation of this technique has been to feed an array of square or nearly square patch antennas at right angles. If the array is large enough, it can serve as the main aperture; if not, it can act as a feed to a larger reflector or lens. One drawback to this technique is that the intrinsic isolation between the vertical and horizontal feeds to a single patch, is typically very low (20 dB or less). Isolation can be increased with the use of patch array techniques. However, as patch antennas are typically narrowband in nature, both transmit and receive signal responses tend to be very narrowband.

Further, there are quasi-optical feed-plus-main-aperture schemes for antenna separation which exist. For example, it is known to use a polarizer to split/combine the beams to/from the transmitter antenna and the receiver antenna. FIG. 1 illustrates a quasi-optical split polarization antenna separation scheme in which the transmit antenna and the receive antenna have orthogonal polarization. In this, there is provided a transmit horn 10 having a transmit signal radiation pattern 11 and a receiver horn 20 having a receive signal radiation pattern 21. A polarizer 15 receives the transmit signal T from the transmit horn 10 then splits the transmit signal T and distributes it to the main aperture lens 25. Polarizer 15 also receives a received signal R from the main aperture lens 25 and distributes it to the receive horn 20. This arrangement is rather bulky, although not so much as if completely separate optics are used. The polarizer must typically be quite large, often almost as large as the main aperture, in order to assure uniform illumination and preserve polarization Another antenna separation technique utilizes a split-focus main reflector in which a main aperture is made up of a large array of polarization-dependent and position-dependent mini-reflectors. The focal point of the split-focus main reflector is different for the two polarizations. Two small feed antennas that are spatially separated by an amount considerably smaller than the diameter of the main aperture, can then be used for transmit and receive operations. Since each mini-reflector is itself a dual-polarized antenna which differs from its neighbors, implementation can be rather complex and difficult to achieve.

Both design and manufacturing costs tend to be quite expensive where a large main aperture is used. Furthermore, in both of the above quasi-optical split-feed antenna separation techniques, substantial effort/expense is typically required to design and engineer the angularly separated transmit and receive housings.

Thus, given the above noted shortcomings of the prior art, an unaddressed need exists in the industry to address the aforementioned, as well as other, deficiencies and inadequacies.

SUMMARY OF THE INVENTION

The present invention provides a common focus antenna for use in radio frequency, microwave or optical applications. Briefly described, in architecture, a preferred embodiment of the common focus antenna can be implemented as follows. There is provided a substrate having a first surface on which a metal film is attached. Three slot antenna sets are formed in the metal film, and a lens is attached to a second surface area of the substrate. The slot antenna sets are generally arranged on the metal film so that two of the antenna sets are parallel to each other while the third antenna set is positioned between the parallel antenna sets and perpendicular thereto.

Other systems, methods, features, and advantages of the present invention will be or become apparent to one of ordinary skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

The present invention provides for a full duplex antenna which has high isolation and wide bandwidth and requires minimal area and volume to implement.

Figure 1:
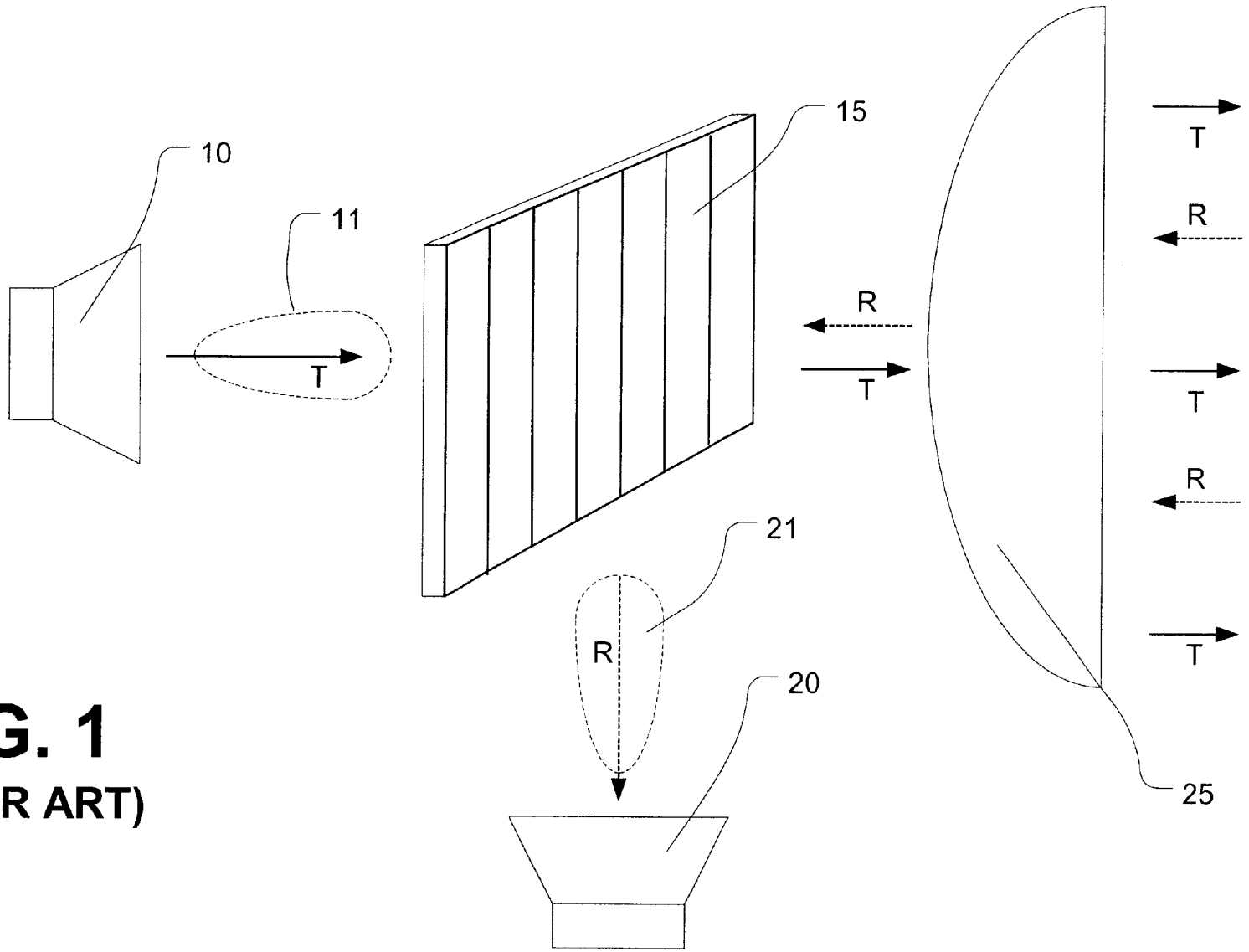
FIG. 1 (PRIOR ART)
FIG. 1 is an illustration of the prior art.
Figure 2A:
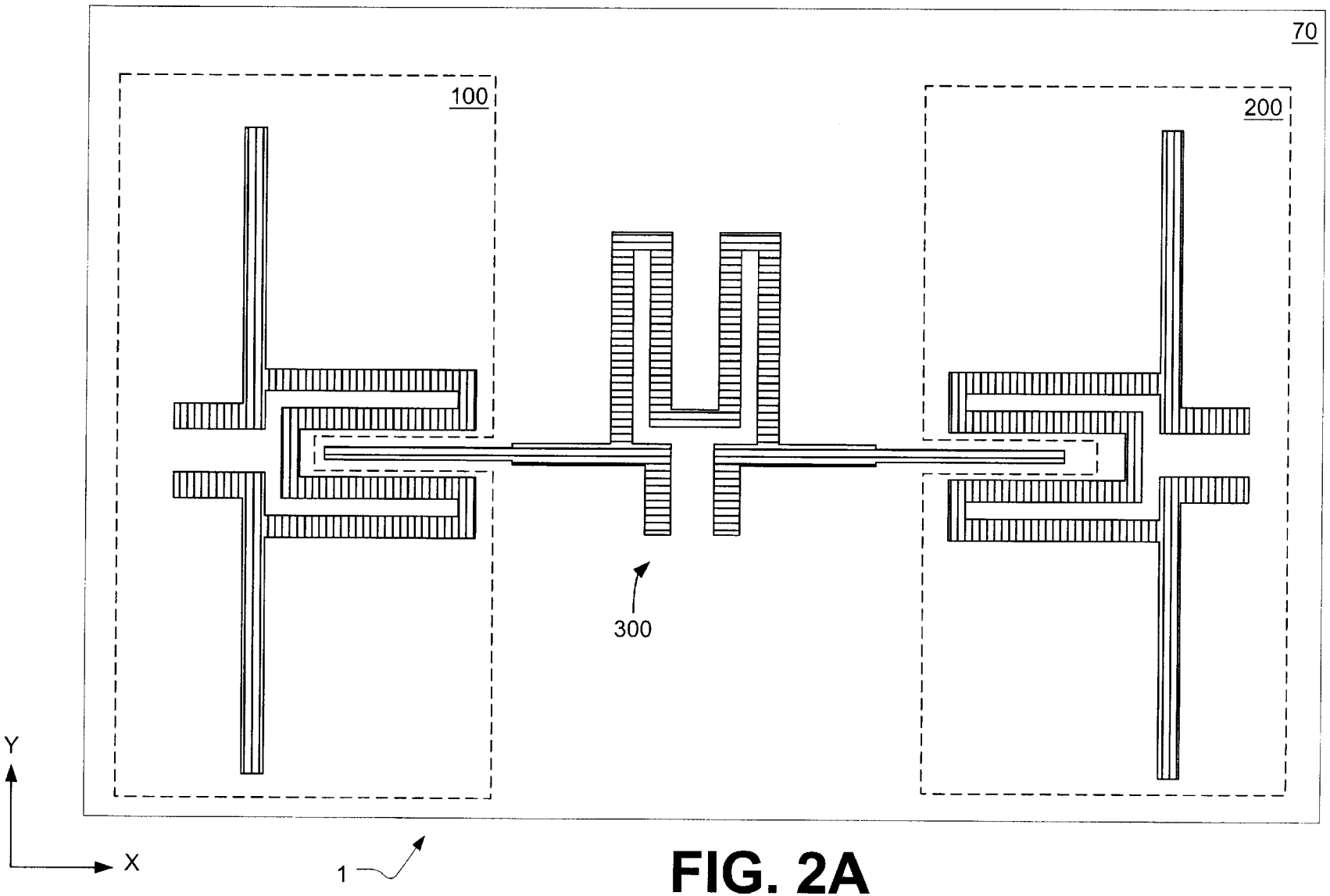
FIG. 2A is a diagram illustrating a preferred arrangement of the slot antenna elements in a metal film attached to a substrate.

With reference to FIG. 2A there is shown an antenna 1 which is made up of three slot antenna sets 100, 200 and 300 formed in a metallic film layer 70. Metallic film layer 70 is attached to a substrate 75 (shown in FIG. 3). Substrate 75 is high dielectric constant substrate made of, for example, alumina.

Figure 2B:
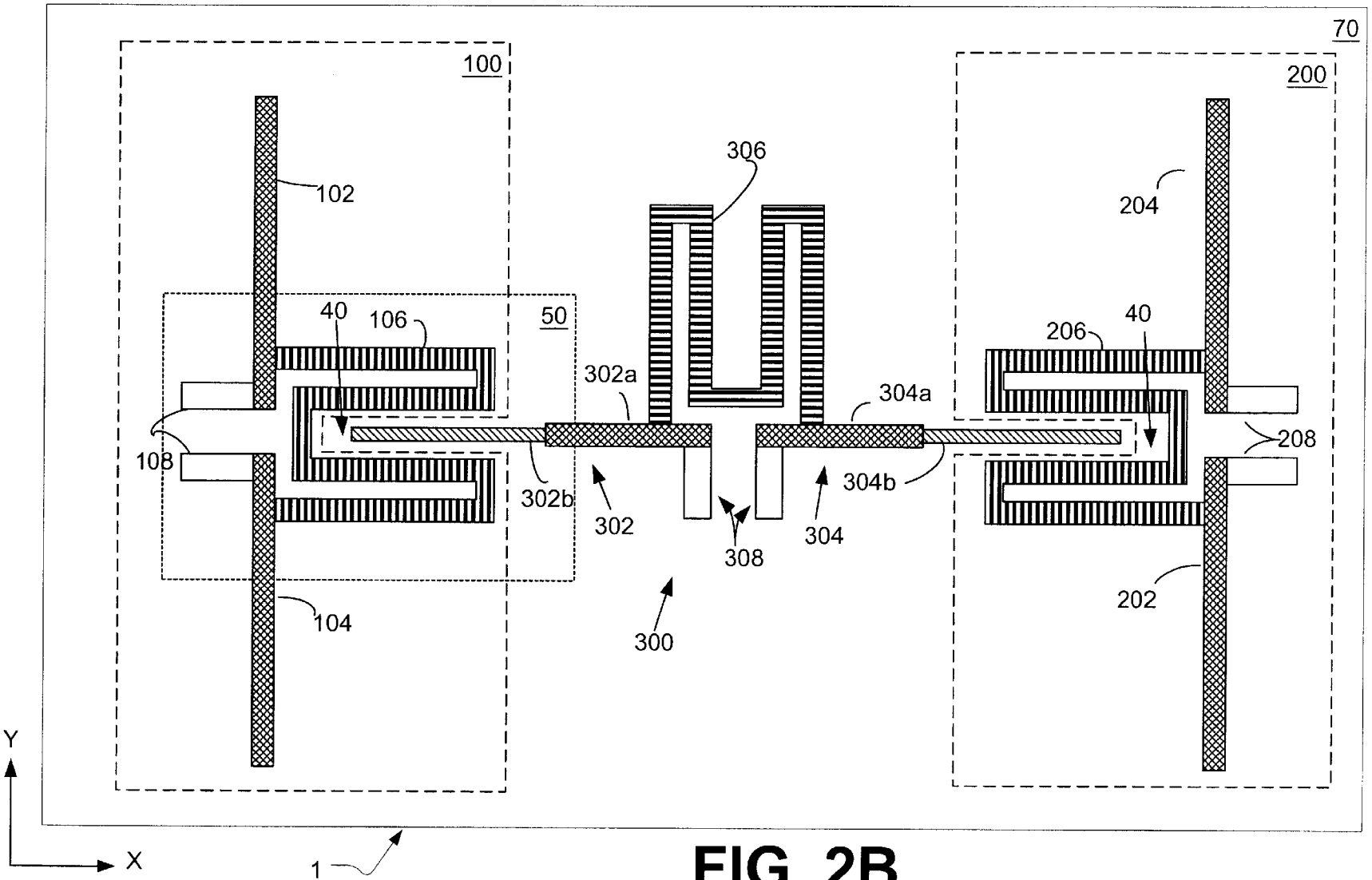
FIG. 2B is a diagram further illustrating the slot antenna sets of the present invention.
Figure 2C:
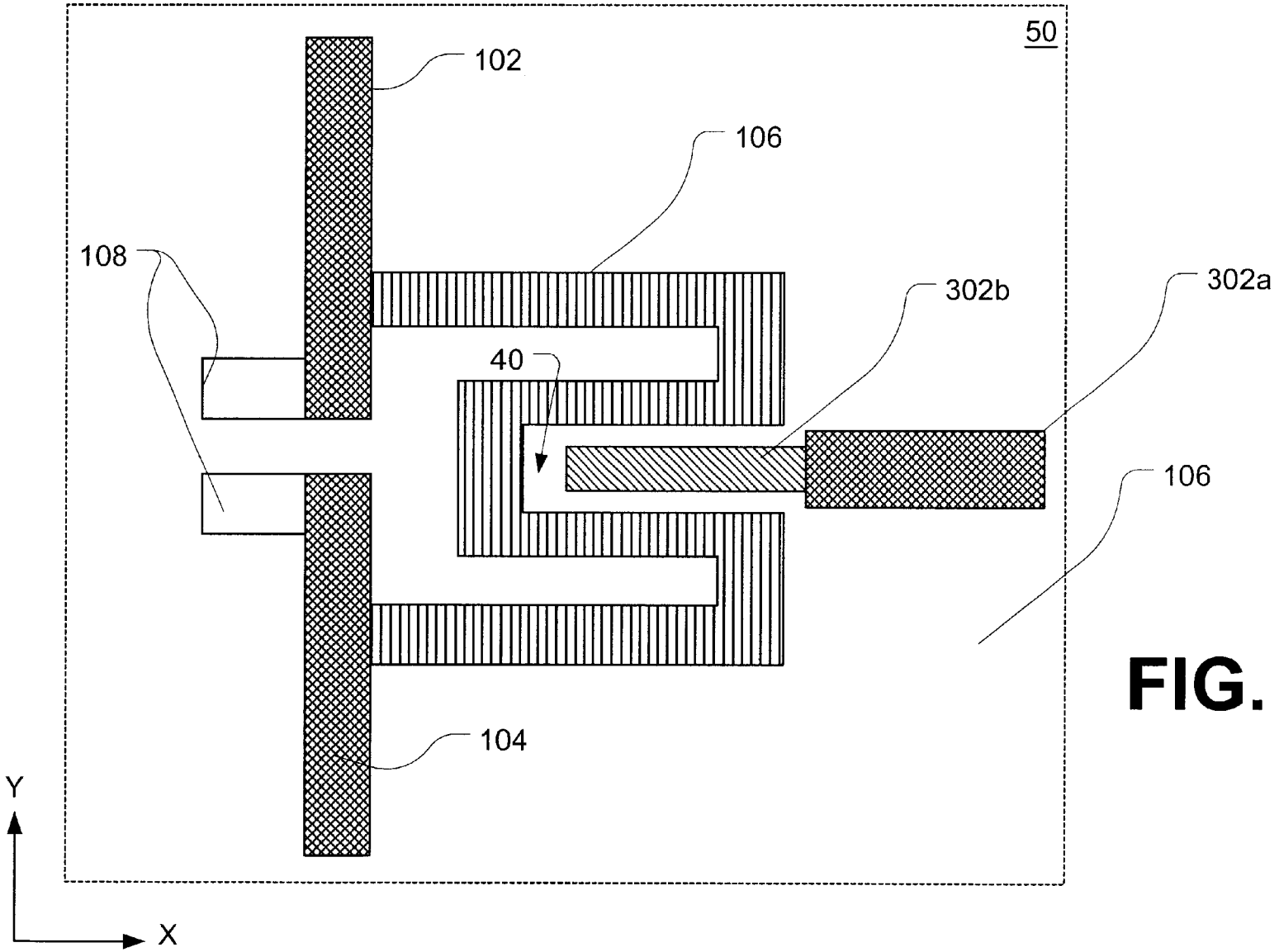
FIG. 2C is a diagram illustrating interpenetration of antenna set 300 with antenna set 100.

In FIG. 2B it can be seen that antenna set 100 is made up of slot 102 and slot 104 that are aligned vertically, end to end, with each other. Antenna set 200 is made up of slot 202 and slot 204 which are also aligned vertically, end to end, with each other. Antenna set 300 is made up of tandem slots 302*a* and 302*b*, as well as tandem slots 304*a* and 304*b*, which are aligned horizontally, end-to-end, with each other. With reference to FIG. 2C, it can be seen that slot 302*b* (penetrating slot 302*b*) penetrates an interdigitated planar tuning capacitor (IDT capacitor) 106 of slot antenna set 100. Similarly, slot 304*b* (penetrating slot 304*b*) penetrates the IDT capacitor 206 of slot antenna set 200 (FIG. 2B).

Figure 3:
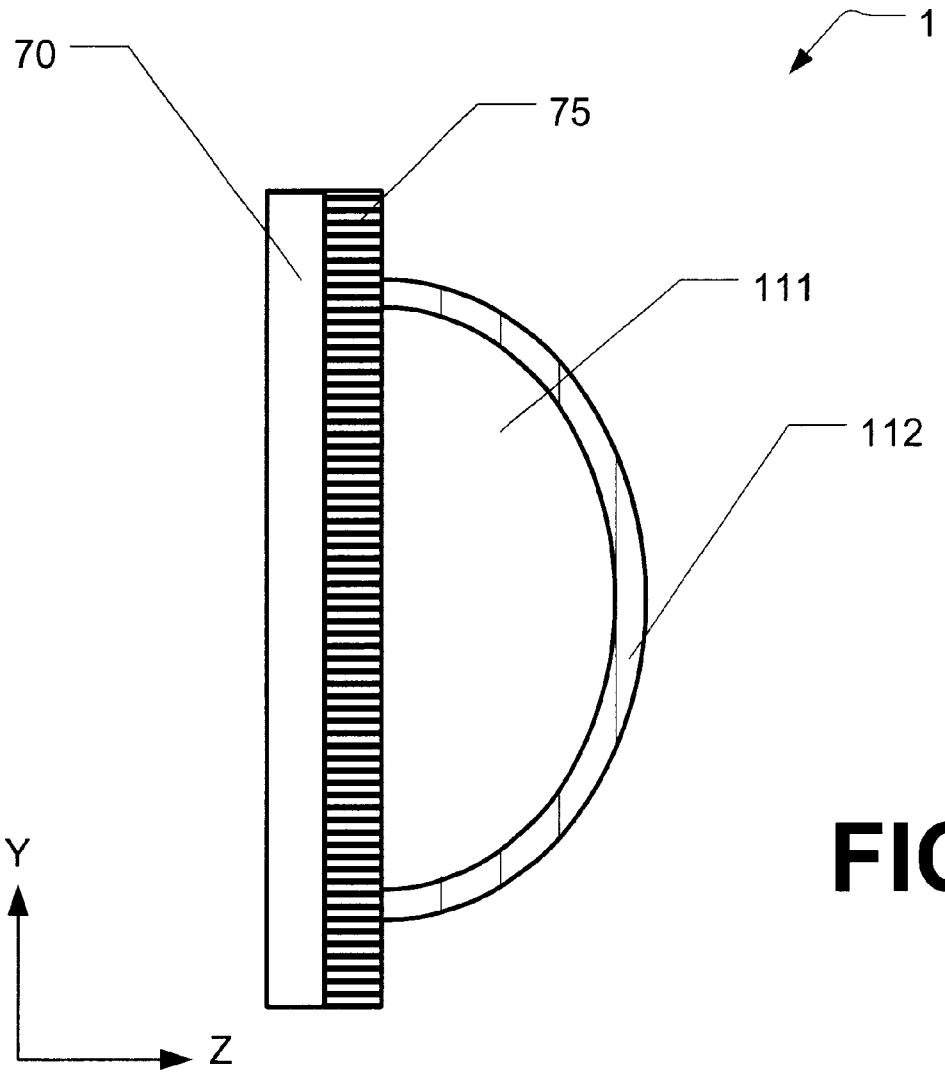
FIG. 3 is a side view illustrating one embodiment of the antenna of the present invention.

Antenna sets 100 and 200 are aligned generally parallel to an axis y. While antenna set 300 is aligned generally parallel to an axis x which is perpendicular to the axis y. It will be recognized that antennas 100 and 200 could also be arranged generally parallel to the axis x, while antenna set 300 could be arranged generally parallel to the axis y. The slot antenna sets 100, 200 and 300 are generally arranged in the shape of the letter "H". The two vertical slot arms 102 and 104 of antenna set 100 and the two slot arms 202 and 204 of antenna set 200 form a transmit antenna while a single slot antenna set 300 forms a receive antenna. Antenna sets 100 and 200, as well as antenna set 300 are implemented as polarized slot antennas on the substrate 75 (FIG. 3). More particularly, they are implemented as transmit and receive slot antennas having orthogonal polarization wherein the antenna sets 100 and 200 are interpenetrated via the slot arms 302 and 304 respectively, of slot antenna set 300 (inter-penetrating, orthogonally polarized slot antennas).

Each slot antenna set 100, 200 and 300 is fed by a coplanar waveguide (CPW) transmission line 108, 208 and 308, respectively. In the case of the transmit antenna set pair 100 and 200, these CPW lines 108 and 208 emanate as equal-length lines from a CPW "rat-race" 502 (FIG. 8) or equivalently any broad-band CPW balun. The pair of transmit antenna sets 100 and 200 and receive antenna set 300 are orthogonally polarized and radiate broadside through the substrate in a direction generally perpendicular to the substrate 75.

In FIG. 2B, each of slot antenna sets 100, 200 and 300 has an IDT capacitor 106, 206 and 306 respectively. The use of the IDT capacitors enable shortening of the length of the individual slot antenna arms 102, 104, 202, 204 and 302 and 304, with only a small decrease in bandwidth. These capacitors are in series with the slot antenna arms 102 and 104, 202 and 204, and 302 and 304. It will be noted that tandem slots 302*a* and 302*b* constitute slot antenna arm 302, whereas tandem slots 304*a* and 304*b* constitute slot antenna arm 304. A typical value for IDT capacitors 106, 206 and 306 is, for example, 30 fF for a center frequency of 60 GHz. By arranging the receive antenna set 300 so that slot arms 302*b* and 304*b* penetrate the IDT capacitors 106 and 206, the area occupied by the antenna 1 is reduced.

The end inductance of the penetrating slots 302*b* and 304*b* is increased by the narrow "ground" metal region 40 of metal film 70 (FIG. 2B) which is located between penetrating slots 302*b* or 304*b* and IDT capacitors 106 or 206. At low frequencies, typically frequencies lower than the resonant frequency of the slot antenna set, the slot antenna set 300 of FIG. 2B, for example, has a higher reactance than a slot antenna set with uniformly wide ground metal and the same overall length, such as with antenna arms 306 and 307 of slot antenna set 300 shown in FIG. 5 and thus has a lower resonant frequency.

For a given operating frequency, the length of tandem slots 302*a*/302*b* and 304*a*/304*b* is shorter than would be necessary for an antenna set without penetration of the IDT capacitor by adjacent slot sets. For example, in the present invention, the tandem slots 302*a*/302*b* and 304*a*/304*b* could be up to 50% shorter in length than a functionally equivalent non-penetrating slot antenna. The combination of high dielectric constant substrate 75 (FIG. 3), the "H" configuration, IDT capacitor tuning, and interpenetration of the penetrating slot arms 302 and 304 into respective IDT capacitors 106 and 206, allows for the antenna of the present invention to be implemented with very small space and volume requirements.

Figure 4:
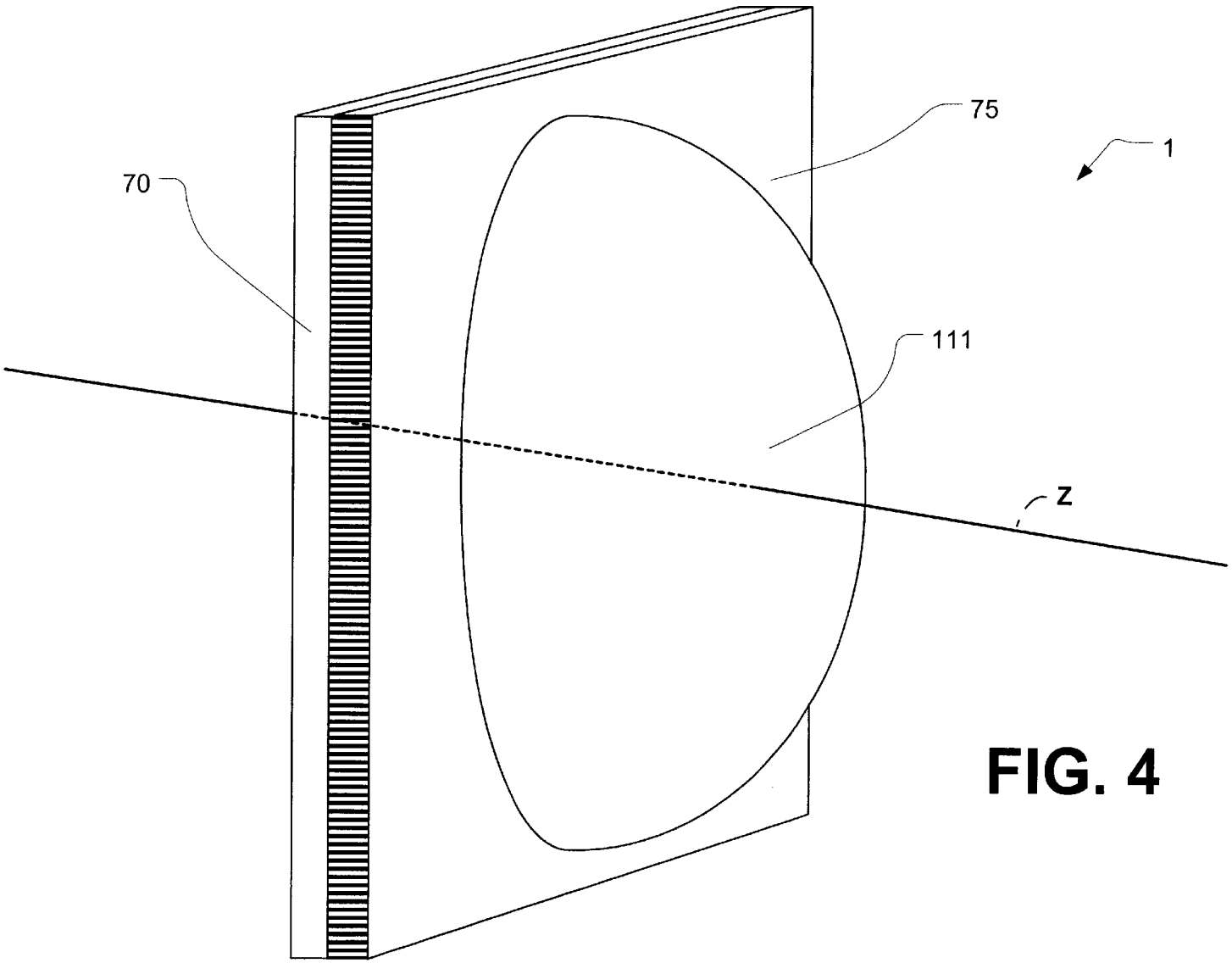
FIG. 4 is a perspective view of one embodiment of the antenna of the present invention.

With reference to FIG. 3 and FIG. 4, an embodiment of the antenna of the present invention is shown. Substrate 75 is shown with metal film layer 70 attached along one surface of the substrate 75. An ellipsoidal shaped lens 111 is attached to the surface of the substrate 75, opposite the metallic film layer 70. Lens 111 is centered along a perpendicular axis Z (FIG. 4) as is the antenna 1. Further, lens 111 is preferably made of a material having the same, or nearly the same, dielectric constant as the substrate 75. A vacuum-formed or thermally-molded anti-reflection (AR) shell 112 is fit over the ellipsoidal lens 111. Shell 112 is preferably made of a moderate dielectric constant plastic such as polystyrene or polyethylene terephthalate-glycol modified (PETG), for example.

Figure 5:
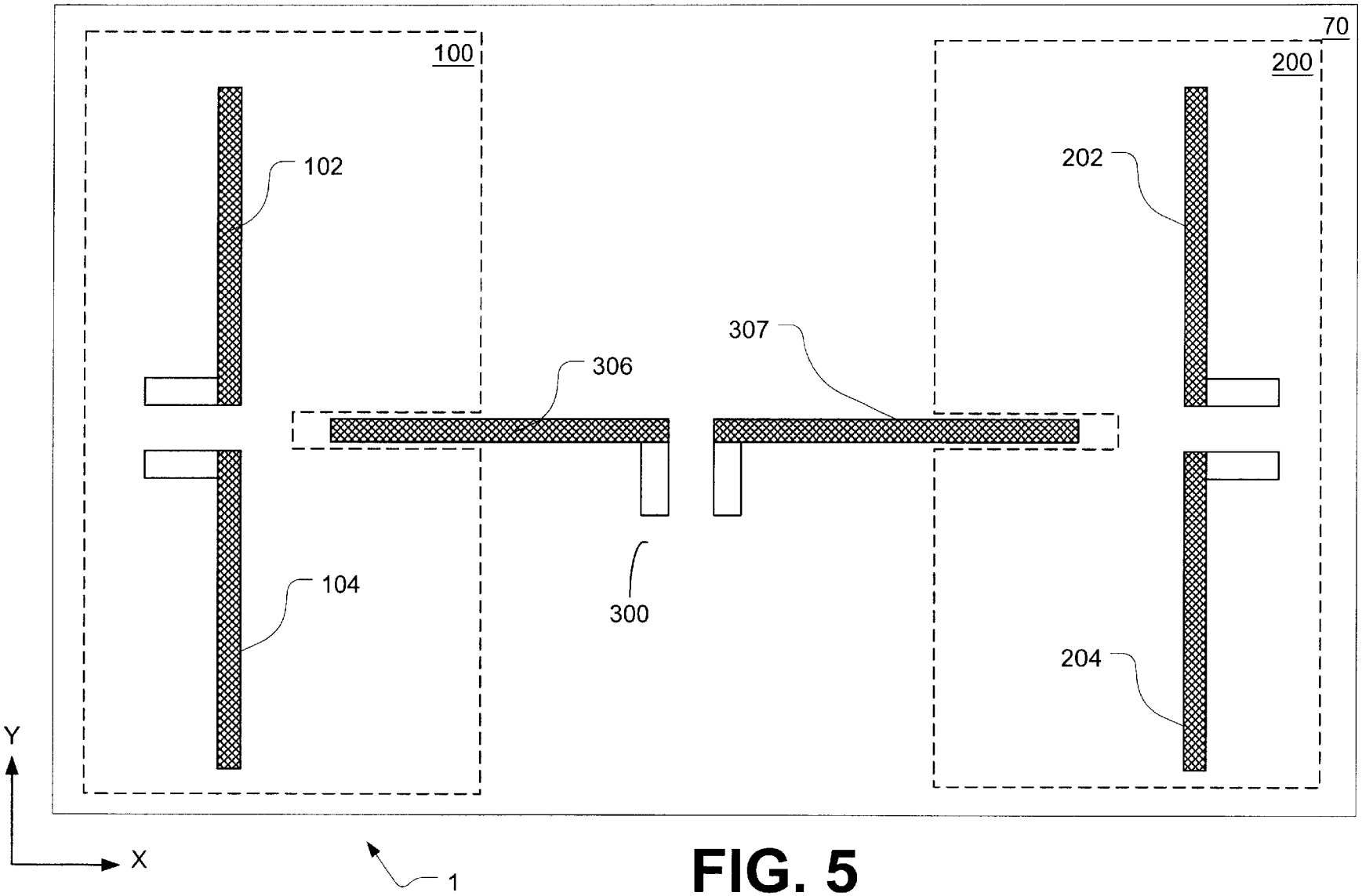
FIG. 5 is an illustration of a further embodiment of the present invention.

Another embodiment of the present invention is shown in FIG. 5. In this embodiment IDT capacitors 106, 206 and 306 are omitted. Slots 306 and 307 are uniform width for the entire length of the slot and do not interpenetrate an IDT capacitor 106. In this embodiment, without the benefits provided by the IDT capacitors 106, 206 and 306 in allowing reduction of the overall length of the antenna set 300, slots 306 and 307 will typically be up to 100% greater in length than an antenna set incorporating the IDT capacitors 106, 206 and 306 as shown in FIG. 2A.

Figure 6:
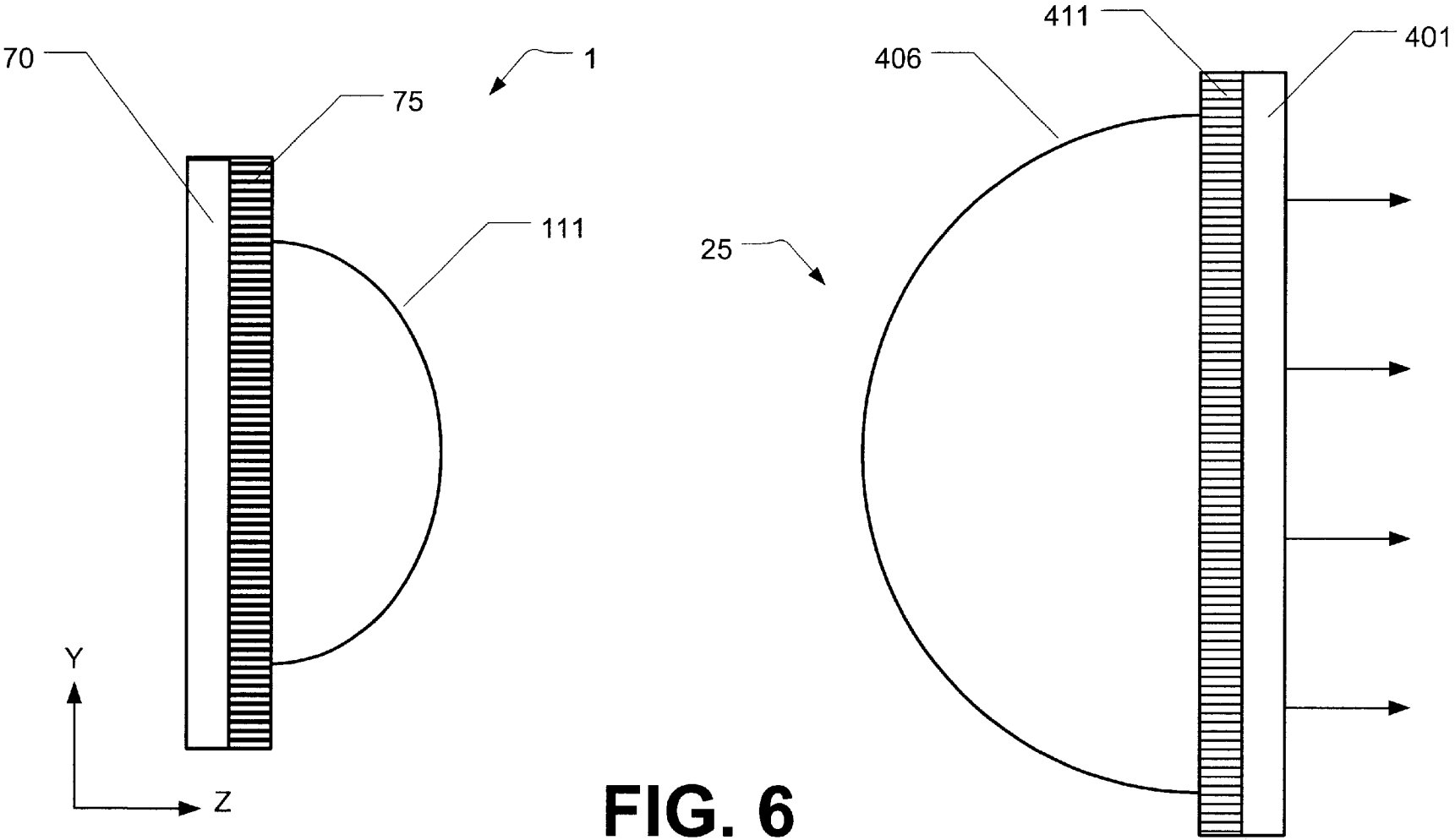
FIG. 6 is a side view of further embodiment of the present invention.

FIG. 6 illustrates an embodiment of the present invention in which antenna 1 is aligned with a large common focus aperture 25 which is common to both the transmit and receive antenna sets of antenna 1. Aperture 25 is composed of a hyperboloid lens 406. Lens 406 is, for example, preferably made of a low dielectric constant, low-loss plastic, such as TEFLON® or high-density polyethylene. Lens 406 is attached to a patterned metallic sheet 411 that is attached to a surface disk 401. Metallic sheet 411 is preferably a sheet of KAPTON® polyimide film. Sheet 411 is, for example, approximately 25 $\mu$m in thickness, although various other thicknesses may be utilized depending on the particular application. A pattern such as, for example, a hexagonal array of circular patches, a square array of square patches, or a square wire grid is defined on the metallic sheet 411.

Figure 7:
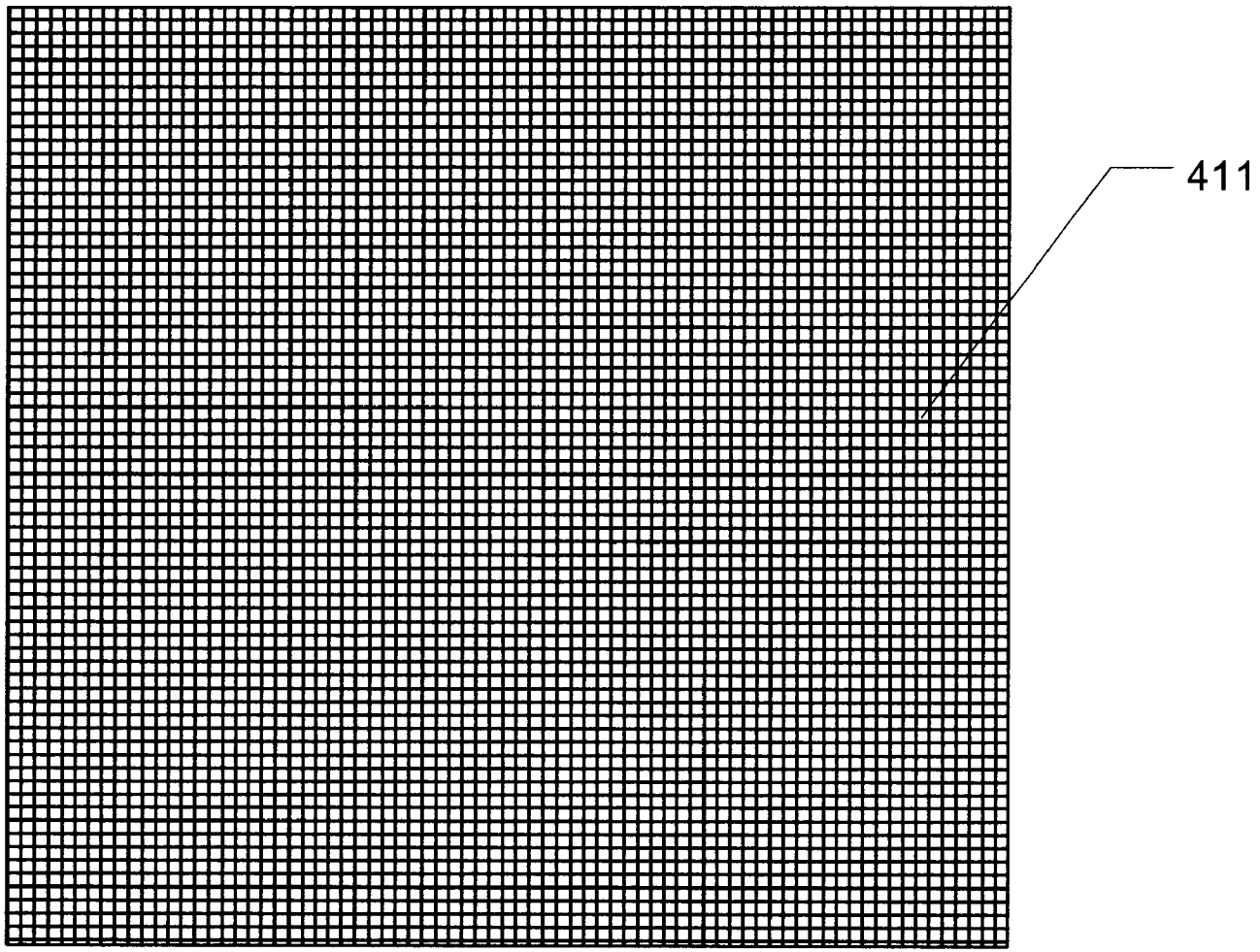
FIG. 7 is an illustration of a mesh pattern array formed in a metallic sheet 411.

FIG. 7 illustrates a square wire grid-patterned metallic sheet 411. Surface disk 401 is preferably made of the same material as lens 406. Use of a metallic sheet in conjunction with a dielectric lens is set out in the article by E. M. T. Jones and S. B. Cohn, entitled "Surface Matching of Dielectric Lenses," Journal of Applied Physics, Vol. 26, No. 4, pp. 452–457, the disclosure of which is hereby incorporated by reference.

Figure 8:
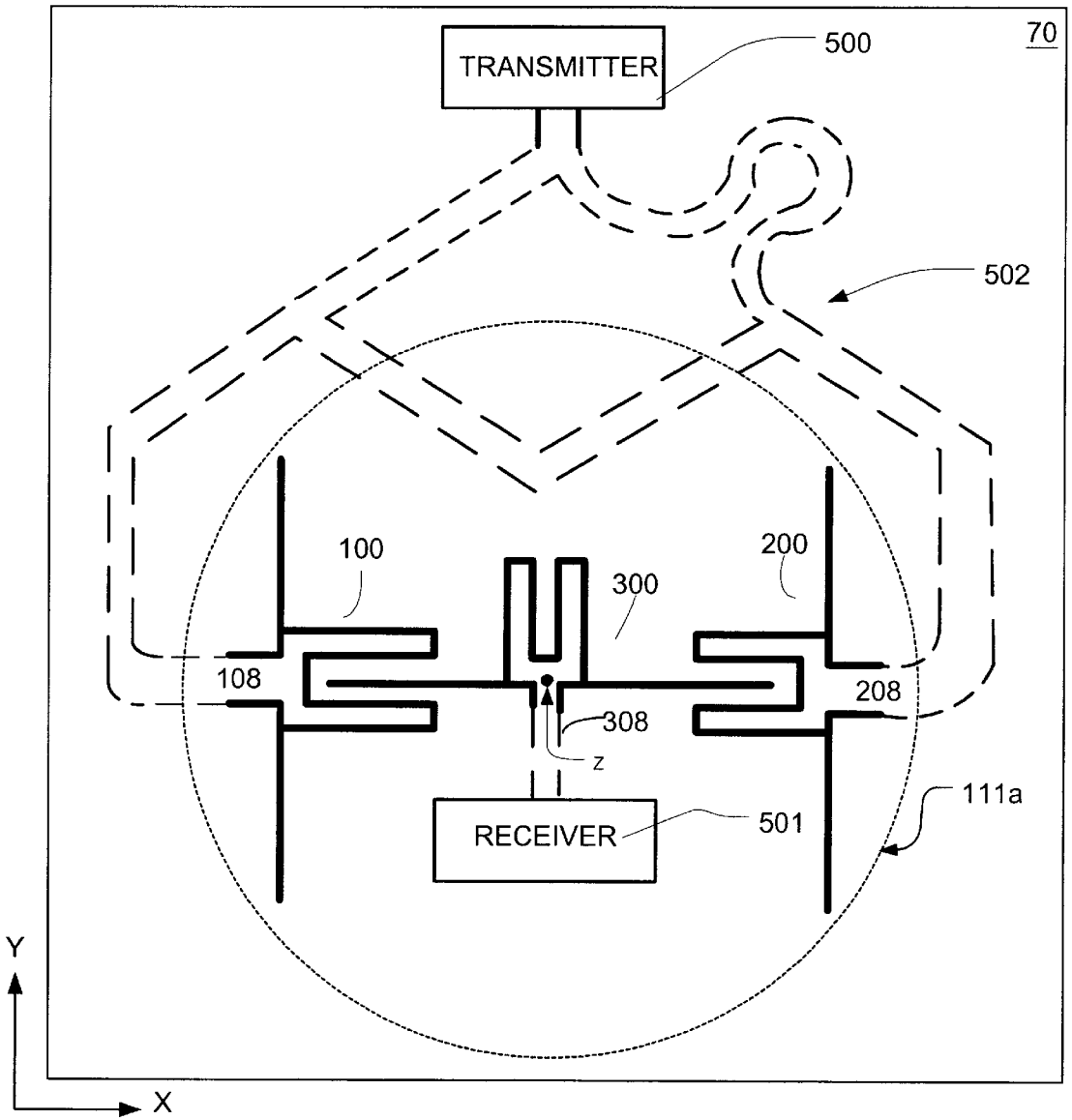
FIG. 8 is an illustration of a preferred antenna of the present invention formed within a metal film on a substrate that contains transmitter and receiver circuitry.

A balun can be used to drive the two vertical slot antenna sets 100 and 200. A balun is a passive network that delivers equal and opposite radio-frequency (RF) voltage (current). One example of a balun which can be used is shown in FIG. 8. As depicted therein, a complete CPW layout is illustrated of a dual-polarized "H" antenna, with "rat-race" network 502. Here, "rat-race" balun circuit 502 provides radio frequency signals, from transmitter 500, of equal and opposite amplitude and phase to each of slot antenna sets 100 and 200 via CPW 108 and 208, respectively.

A CPW feed network, which includes rat-race balun circuit 502 connected between transmitter antenna sets 100 and 200 and transmitter circuit 500; and CPW 308, which is connected between receive circuit 501 and receiver antenna set 300, is shown in FIG. 8. As substrate 75 is preferably made of alumina, it is possible for substrate 75 to incorporate receiver and transmitter integrated circuits (active chips) made of, for example, GaAs, Si, or InP. Thus, antenna sets 100, 200 and 300 can be easily integrated with a typical microwave substrate having integrated circuitry. FIG. 8 illustrates the antenna of the present invention formed in a metal film 70, which is attached to a substrate 75. Substrate 75 includes an integrated circuit that forms the transmitter 500 and the receiver 501. It can be seen that antenna set 100 and antenna set 200 are connected to transmitter 500 via a "rat-race" balun arrangement. Further, receiver 501 is connected to antenna set 300. It will be understood that antenna sets 100, 200 and 300 as well as "rat-race" balun 502 and CPW 308 are formed in the metallic layer 70, while all integrated circuits related to transmitter 500 and receiver 501 are formed in substrate 75 (not shown). Further, it should be noted that ellipsoidal shaped lens 111 (FIG. 6) is aligned so that its footprint 111*a* is centrally aligned along a common axis Z so as to inscribe the slot antenna sets 100, 200 and 300 within the boundary of its footprint.

Figure 9:
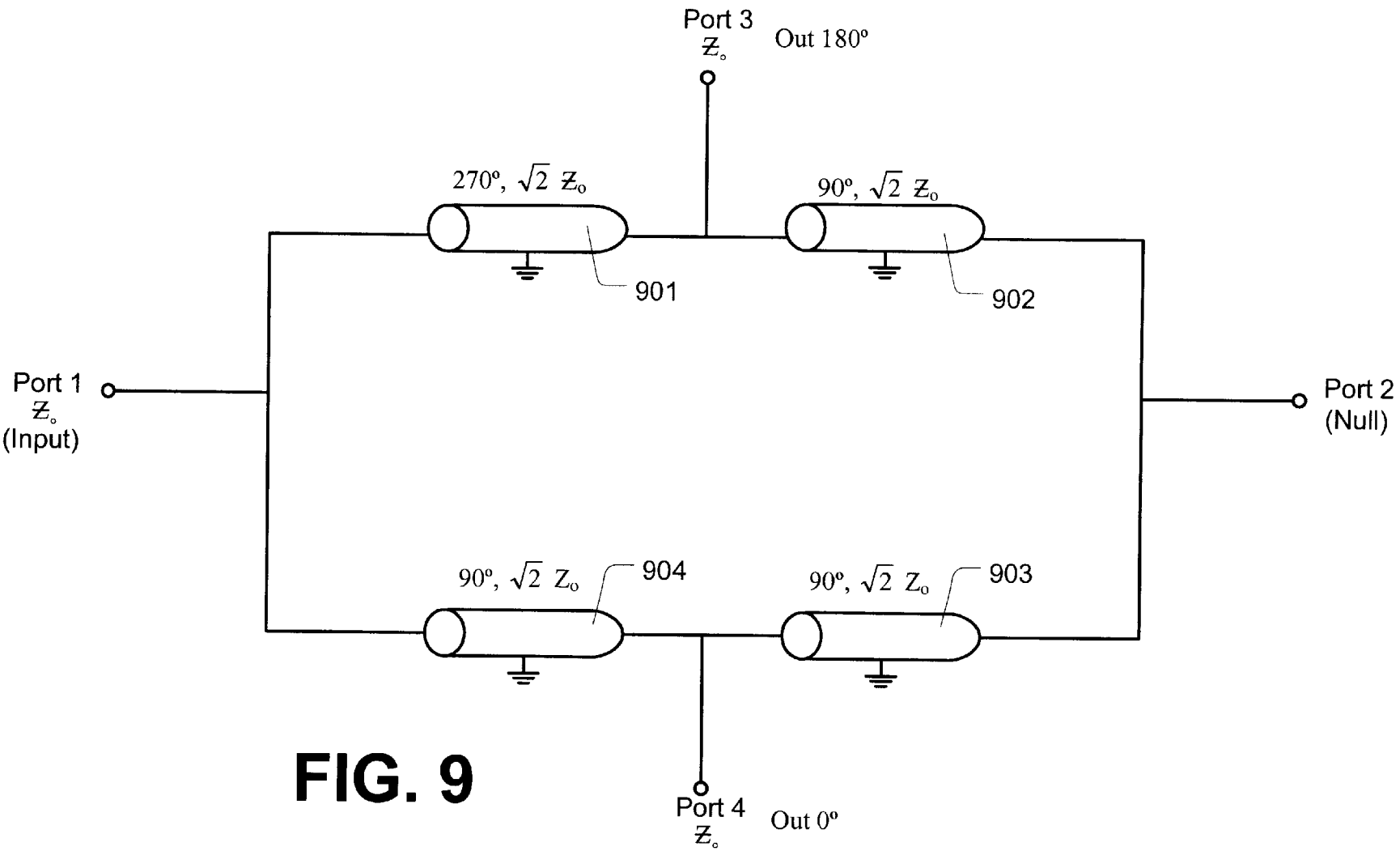
FIG. 9 is an equivalent schematic diagram of an example of a rat-race balun which can be used to connect a transmitter antenna set to a transmitter circuit.

An electrical equivalent circuit schematic of the "rat-race" balun shown in FIG. 8 is illustrated in FIG. 9. PORT 1 is the input to the balun from transmitter 500. PORT 2 is a dummy or null port. PORT 3 and PORT 4 are output ports to the transmit antenna sets 200 and 100, respectively. PORT 3 and PORT 4 share power equally (50/50) and in opposite phase to each other (180 degrees out of phase). PORT 2 is left open-circuited thereby providing a broader bandwidth balun. Alternatively, PORT 2 can be terminated in a matched load, for example 50 ohms. A first transmission line 901 having an impedance of, for example, 71 ohms, separates PORT 1 and PORT 3 by 270°. PORT 3 is separated from PORT 2 by transmission line 902, and is 90° out of phase from PORT 2. PORT 2 is separated from PORT 4 by transmission line 903, and is 90° out of phase from PORT 4. PORT 4 is separated from PORT 1 by transmission line 904 and is 90° out of phase from PORT 1. Transmission lines 901, 902, 903 and 904 have, for example, impedances of 71 ohms.

As the microwave/millimeter-wave spectrum packages often utilize an alumina (or equivalent) substrate having one or more GaAs, Si, or InP integrated circuit chips, it is possible to avoid having to use lossy and/or costly transitions to microstrip or waveguide to access the antennas by putting the antenna set on the very same alumina substrate 75 that carries the active chips. The transmitter, the receiver, and the antennas can all be supported by on the same substrate 75, thus providing a compact and cost-effective common-focus antenna. Since the radiation of an RF signal in the present invention is through the substrate 75, integrated circuit chips which might be used to implement transmitter and receiver circuits 500 and 501, can be easily sealed from the environment.

The present invention produces much higher isolation (40–50 dB) than achievable with a dual-polarized patch antenna array. The H-slot antenna of the present invention provides for greater bandwidth than a typical patch antenna system. This is particularly so when the H-slot antenna of the present invention is used in conjunction with a rat-race balun with open-circuited null port as shown in FIG. 8.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the principles of the invention. All such modifications and variations are intended to be included herein within the scope of this disclosure and the present invention and protected by the following claims.

What is claimed:

1. A common focus transmit-receive antenna, comprising:

a substrate having a first surface and a second surface;

a metal film attached to said first surface;

said metal film comprising a slot antenna and a feeder network for feeding said slot antenna; and a lens having a high dielectric constant attached to said second surface of said substrate.

2. A common focus transmit-receive antenna according to claim 1, wherein said slot antenna comprises first, second and third slot antennas.

3. A common focus transmit-receive antenna according to claim 2, wherein each of said first, second and third slot antennas comprise an interdigitated planar tuning capacitor.

4. A common focus transmit-receive antenna according to claim 2, wherein each of said first, second and third slot antennas is elongated.

5. A common focus transmit-receive antenna according to claim 3, wherein said first and second slot antennas are aligned substantially parallel to each other, and said third slot antenna is aligned substantially perpendicular to said first and said second slot antennas.

6. A common focus transmit-receive antenna according to claim 4, wherein said first and said second slot antennas constitute a transmit antenna.

7. A common focus transmit-receive antenna according to claim 4, wherein said first and said second slot antennas constitute a receive antenna.

8. A common focus transmit-receive antenna according to claim 4, wherein said third slot antenna constitutes a transmit antenna.

9. A common focus transmit-receive antenna according to claim 4, wherein said third slot antenna constitutes a receive antenna.

10. A common focus transmit-receive antenna according to claim 1, wherein said substrate comprises a high dielectric constant material.

11. A common focus transmit-receive antenna according to claim 10, wherein said substrate comprises alumina.

12. A common focus transmit-receive antenna according to claim 10, wherein said high dielectric constant substrate further comprises radio-frequency processing circuitry.

13. A common focus transmit-receive antenna according to claim 1, further comprising an anti-reflection shell configured to fit over said lens.

14. A common focus transmit-receive antenna according to claim 13, wherein said anti-reflection shell comprises a moderate dielectric constant plastic.

15. A common focus transmit-receive antenna according to claim 14, wherein said moderate dielectric constant plastic comprises polystyrene.

16. A common focus transmit-receive antenna according to claim 14, wherein said moderate dielectric constant plastic comprises polyethylene terephthalate-glycol modified (PETG).

17. A common focus transmit-receive antenna according to claim 1, wherein said lens comprises an ellipsoidal shaped lens.

18. A radio frequency transceiver comprising:

a substrate comprising a first surface, a second surface, and radio frequency processing circuitry;

an antenna formed on said first surface of said substrate;

an ellipsoidal shaped lens attached to said second surface of said substrate; and anti-reflective shell attached to said ellipsoidal shaped lens, opposite said second surface of said substrate.

19. A radio frequency transceiver according to claim 18, wherein said antenna comprises a slot antenna set.

20. A radio frequency transceiver according to claim 19, wherein said slot antenna set comprises three slot antenna sets substantially arranged in the general shape of the letter "H".

* * * * *